US009976553B2

(12) United States Patent
Lai

(10) Patent No.: US 9,976,553 B2
(45) Date of Patent: May 22, 2018

(54) OUTPUT SHAFT LUBRICATING STRUCTURE OF LIQUID PRESSURIZING PUMP

(71) Applicant: Chien fu Lai, Taichung (TW)

(72) Inventor: Chien fu Lai, Taichung (TW)

(73) Assignee: Jongherya Co., Ltd., Taichung (TW)

( * ) Notice: Subject to any disclaimer, the term of this patent is extended or adjusted under 35 U.S.C. 154(b) by 316 days.

(21) Appl. No.: 14/834,456

(22) Filed: Aug. 25, 2015

(65) Prior Publication Data

US 2015/0361976 A1 Dec. 17, 2015

(51) Int. Cl.

| | |
|---|---|
| ***F04B 53/18*** | (2006.01) |
| ***F04B 1/04*** | (2006.01) |
| ***F04B 39/02*** | (2006.01) |
| *F04B 53/14* | (2006.01) |
| *F04B 53/00* | (2006.01) |

(52) U.S. Cl.

CPC ..... *F04B 53/18* (2013.01); *F04B 1/0413* (2013.01); *F04B 1/0421* (2013.01); *F04B 39/0261* (2013.01); *F04B 1/0408* (2013.01); *F04B 53/006* (2013.01); *F04B 53/14* (2013.01)

(58) Field of Classification Search

CPC .... F04B 53/18; F04B 53/006; F04B 53/1002; F04B 53/1015; F04B 1/0413; F04B 1/0421; F04B 1/0404; F04B 1/0443; F04B 39/02; F04B 39/0207; F04B 39/0284; F04B 39/0276; F04B 39/0261; F04B 39/0238; F04B 39/0246; F01M 2001/023; F01M 2001/0253; F01M 2001/0284; F16N 13/02; F16N 13/04; F16N 13/18; F16N 11/06

See application file for complete search history.

(56) References Cited

U.S. PATENT DOCUMENTS

| | | | | |
|---|---|---|---|---|
| 2,063,728 A * | 12/1936 | De Ville | F04B 23/06 417/413.1 |
| 2,106,488 A * | 1/1938 | McCune | F04B 27/053 417/203 |
| 2007/0183911 A1* | 8/2007 | Maeda | B60T 8/4031 417/470 |
| 2008/0060513 A1* | 3/2008 | Miller | F04B 1/0408 92/172 |

* cited by examiner

*Primary Examiner* — Bryan Lettman
*Assistant Examiner* — Timothy Solak

(57) ABSTRACT

An output shaft lubricating structure of a liquid pressurizing pump is provided. A first eccentric portion of an output shaft acts as the maximum stress for load when the liquid is pressurized and works. By the power of the output shaft, a telescopic piston of an oil supply device is directly pushed by a second eccentric portion to draw the lubricating oil in a circular core hole and to pressurize and supply the lubricating oil to an oil supply hole of the output shaft to force an oil outlet hole to drain the lubricating oil to the surface of the first eccentric portion for circulatory supplement, such that the turning of a turning wheel on the first eccentric portion can keep better lubrication for a long time so as to prolong the service life of the output shaft and the turning wheel.

8 Claims, 9 Drawing Sheets

OUTPUT SHAFT LUBRICATING STRUCTURE OF LIQUID PRESSURIZING PUMP

BACKGROUND OF THE INVENTION

1. Field of the Invention

The invention relates to an output shaft lubricating structure of a liquid pressurizing pump, and more particularly to a pump capable of keeping better lubrication for an output shaft and a turning sleeve, reducing wear and tear, and prolonging its service life.

2. Description of the Prior Art

Nebulizers used for air-conditioning purposes or horticultural purposes are required to pressurize the liquid in order to spray the liquid through a spray head, providing a desired spraying effect. In general, a liquid pressurizing pump is used for pressurizing the liquid. For a conventional centrifugal blade-type liquid pump, fluid (lift) is as the main consideration, they cannot get a better spraying effect because hydraulic pressure is not high. The nebulizer cannot get a good spraying effect. A conventional whirlpool-type fluid pressurizing pump improves liquid pressurizing. However, the demand for precision of the whirlpool assembly is strict. In the market, the nebulizers are positioned at a low price for production costs. This is not cost-effective. A conventional crankshaft plunger liquid pressurizing pump permits liquid to be pressurized well. However, it uses a crankshaft driven by a motor to pull and push a plunger so as to pressurize the liquid. In consideration of the cranks on the crankshaft not to interfere with each other, the length of the crankshaft must be longer. This needs a larger space for a mechanical movement. It is necessary to manufacture a liquid pressurizing portion and a power mechanical portion separately, which consumes more materials, is large in size, and is not beneficial for installation.

A number of conventional liquid pressurizing pumps are disclosed. Their advantage is compactness. For the eccentric portion of the eccentric shaft to drive the plunger, the eccentric portion is provided with a turning wheel to lower and reduce the friction and wear between the eccentric portion and the plunger end surface by means of the turning wheel to drive the plunger end surface. However, the turning of the surface of the eccentric portion and the tuning wheel lacks lubrication, so the surface of the eccentric portion and the tuning wheel suffer a lot of wear and tear, particularly, in a long period of 1000 psi working pressure. This phenomenon is exacerbated and more obvious. The reason is that the eccentric shaft is directly driven by a quadruple motor (without a deceleration mechanism) at 1720-1740 RPM rotation speed. Although the eccentric portion and the turning wheel are sucked in lubricating oil for working, the rotational speed of both are equal to the turning speed of the eccentric shaft. The eccentric portion and the turning wheel are rotated at a high speed to throw oil centrifugally, which causes the lubricating oil on the surface of the eccentric portion to flow away quickly. The action that the eccentric portion and the turning wheel are rotated at a high speed for the lubricating oil to infiltrate the surface of the eccentric portion may have the problem of bad lubrication because the loss of lubricating oil is not replenished before stopping rotation. If it is able to replenish the lubricating oil during rotation of the eccentric portion, the aforesaid shortcoming can be overcome. The service life of the eccentric shaft and the turning wheel can be prolonged. Even when the working pressure reaches 2600 psi (high pressure), the durability of the eccentric shaft and the turning wheel can be maintained.

SUMMARY OF THE INVENTION

The primary object of the invention is to provide an output shaft lubricating structure of a liquid pressurizing pump. The invention comprises a pump main body, a plurality of pillar plunger cap assemblies, a plurality of pillar plungers, and an output shaft. The pump main body has a circular core hole functioning as a mechanical room and filled with lubricating oil. The circular core hole is provided with a plurality of fixing holes arranged radially and evenly. Each fixing hole is radially provided with a liquid inflow and outflow opening. The liquid inflow and outflow opening is in communication with a check valve. The check valve has a liquid inflow non-return end and a liquid outflow non-return end to communicate with a liquid inlet and a liquid outlet, respectively. Through the liquid inflow non-return end of the check valve, the liquid inflow and outflow opening is able to get an external liquid from the liquid inlet. Each pillar plunger cap assembly comprises a cap body mounted on a corresponding one of the fixing holes of the pump main body. The interior of the cap body has a liquid pressurizing room. One end of the liquid pressurizing room is radially formed with at least one through hole to communicate with the liquid inflow and outflow opening. Each pillar plunger is disposed in the liquid pressurizing room of each pillar plunger cap assembly. An inner end of each pillar plunger extends into the circular core hole of the pump main body. The output shaft is locked by a bottom lid and an inner lid which are located at two ends of the circular core hole of the pump main body respectively. The output shaft is mounted in the circular core hole in an airtight manner. The output shaft has an output end and a main shaft body. The output end extends out of the bottom lid to connect a motor. The main shaft body is driven by the motor to rotate in the circular core hole. The main shaft body is formed with a first eccentric portion relative to the inner end of each pillar plunger. The first eccentric portion is connected with a turning wheel leaning against the inner end of each pillar plunger. By the first eccentric portion to circle around in the circular core hole, the pillar plungers are displaced inward one by one toward the liquid pressurizing room through the eccentric action of the turning wheel, enabling the liquid inside the liquid pressurizing room to be pressurized by the pillar plungers so as to discharge from the liquid inflow and outflow opening. Through the liquid outflow non-return end of the check valve, the pressurized liquid flows out through the liquid outlet for use. The circular core hole of the pump main body is radially provided with an installation hole interlaced with the fixing holes. The output shaft is mounted in the circular core hole by means of the bottom lid and the inner lid. The main shaft body is formed with a second eccentric portion relative to the installation hole. The main shaft body is axially formed with an oil supply hole. The inner lid is formed with an oil through hole relative to the air supply hole. The oil through hole is sealed by an outer lid to form an oil supply room. One end of the oil supply room is connected with an oil pipe through a connector. Another end of the oil supply room is in communication with the oil supply hole via the oil through hole. The oil supply hole is radially formed with at least one oil outlet relative to the first eccentric portion. The oil outlet extends out of the surface of the first eccentric portion. The installation hole of the pump main body is provided with an oil supply device. The oil supply device is disposed at an outer end of the installation hole and provided with an oil outflow check valve. An outer end of the oil outflow check valve is connected with the oil pipe through a pipe connector. The interior of the oil outflow check valve is formed with an oil pressurizing room. The oil pressurizing room is provided with a telescopic piston biased by a compression spring. The telescopic piston has an oil inflow check valve portion able to slide up and down within the oil pressurizing room. One end of the oil inflow check valve portion is provided with a push pipe which extends toward the circular core hole to lean against the second eccentric portion of the output shaft. One end of the push pipe extends into the circular core hole and is provided with at least one drawing oil hole for the oil pressurizing room to communicate with the circular core hole. The first eccentric portion of the output shaft acts as the maximum stress for load when the liquid is pressurized and works. By the power of the output shaft, the telescopic piston of the oil supply device is directly pushed by the second eccentric portion to draw the lubricating oil in the circular core hole and to pressurize and supply the lubricating oil to the oil supply hole of the output shaft to force the oil outlet hole to drain the lubricating oil to the surface of the first eccentric portion for circulatory supplement, such that the turning of the turning wheel on the first eccentric portion can keep better lubrication for a long time so as to prolong the service life of the output shaft and the turning wheel.

Preferably, the oil supply hole inside the output shaft is radially formed with the at least one oil outlet relative to the first eccentric portion. The surface of the first eccentric portion is formed with an annular groove to communicate with the oil outlet, enabling the turning of the turning wheel on the first eccentric portion to get a full lubricating effect.

Preferably, the oil through hole of the inner lid is sealed by the outer lid to form the oil supply room. An oil screen is provided between the oil supply room and the oil through hole. By the oil screen to filter the impurities, the lubricating oil can be purified. Preferably, the oil outflow check valve of the oil supply device has a valve seat. The valve seat is a screw nut to be screwed on a threaded portion of the outer end of the installation hole. The valve seat is formed with a valve room therein. One end of the valve room has an inner threaded hole for connecting the pipe connector. Another end of the valve room has a valve opening to communicate with the oil pressurizing room. The valve room is provided with a tension spring therein. A ball is biased by the tension spring to seal the valve opening, such that the oil coming to the pipe connector flows back to oil pressurizing room.

Preferably, the telescopic piston of the oil supply device has the oil inflow check valve portion. The oil inflow check valve portion is formed with a valve room therein. One end of the valve room is connected with a pipe hole of the push pipe and communicated with the circular core hole through the drawing oil hole. Another end of the valve room is provided with a support member to support a tension spring to press against a ball so as to seal the pipe hole. The support member is formed with a through hole for the valve room to communicate with the oil pressurizing room, such that the oil in the oil pressurizing room flows back to the circular core hole. Preferably, the oil outflow check valve of the oil supply device is fixedly disposed at the outer end of the installation hole. An inner end of the oil outflow check valve is provided with a receiving pipe. The receiving pipe is formed with the oil pressurizing room therein to receive the compression spring and the telescopic piston. The push pipe of the telescopic piston extends into the circular core hole from one end of the receiving pipe to lean against the second eccentric portion of the output shaft, such that the oil supply device can be mounted to or disassembled from the installation hole conveniently.

Preferably, the oil outflow check valve of the oil supply device is fixedly disposed at the outer end of the installation hole. The oil pressurizing room formed at the inner end of the oil outflow check valve, relative to the telescopic piston, is provided with a first slide sleeve made of a wear material for the oil inflow check valve portion to slide and a second slide sleeve made of a wear material for the push pipe to slide, such that the slide movement of the telescopic piston in the oil pressurizing room can reduce friction resistance and wear and tear.

Preferably, one end of the oil supply room inside the outer lid is provided with the connector. The outer end of the oil outflow check valve of the oil supply device is provided with the pipe connector to connect an oil pipe. Another end of the oil pipe is connected with one end of a heat sink. Another end of the heat sink is connected with the connector through another oil pipe. The operating temperate generated by the output shaft to rotate in the circular core hole can be dissipated by using the circulation of the lubricating oil in the circular core hole.

The above and other objects, features and advantages of the invention will become apparent from the following detailed description taken with the accompanying drawings.

DETAILED DESCRIPTION OF THE PREFERRED EMBODIMENTS

Figure 1:
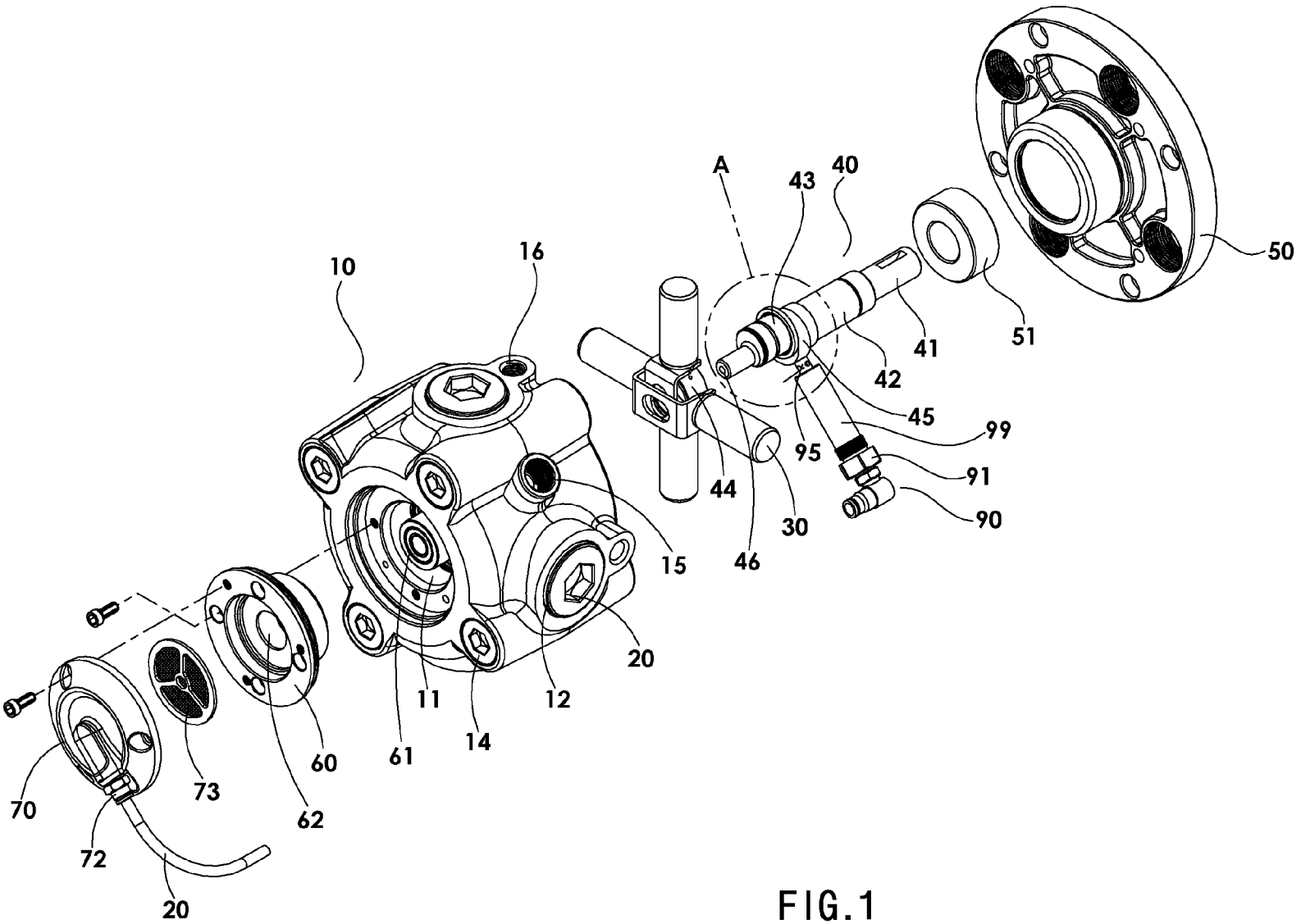
FIG. 1 is an exploded view of the invention.

Embodiments of the invention will now be described, by way of example only, with reference to the accompanying drawings.

As shown in FIG. 1 through FIG. 5, an output shaft lubricating structure of a liquid pressurizing pump according to a preferred embodiment of the invention comprises a pump main body 10, a plurality of pillar plunger cap assemblies 20, a plurality of pillar plungers 30, and an output shaft 40. The pump main body 10 has a circular core hole 11 functioning as a mechanical room and filled with lubricating oil. The circular core hole 11 is provided with a plurality of fixing holes 12 arranged radially and evenly. Each fixing hole 12 is radially provided with a liquid inflow and outflow opening 13. The liquid inflow and outflow opening 13 is in communication with a check valve 14. The check valve 14 has a liquid inflow non-return end and a liquid outflow non-return end to communicate with a liquid inlet 15 and a liquid outlet 16, respectively. Through the liquid inflow non-return end of the check valve 14, the liquid inflow and outflow opening 13 is able to get an external liquid from the liquid inlet 15.

Each pillar plunger cap assembly 20 comprises a cap body 21 mounted on a corresponding one of the fixing holes 12 of the pump main body 10. The interior of the cap body 21 is provided with a plurality of pillar plunger sealing rubber rings 22 to form a liquid pressurizing room 23. One end of the liquid pressurizing room 23 is radially formed with at least one through hole 24 to communicate with the liquid inflow and outflow opening 13. Each pillar plunger 30 is disposed in the liquid pressurizing room 23 of each pillar plunger cap assembly 20. An inner end of each pillar plunger 30 extends into the circular core hole 11 of the pump main body 10. The output shaft 40 is locked by a bottom lid 50 and an inner lid 60 which are located at two ends of the circular core hole 11 of the pump main body 10 respectively.

The output shaft 40 is mounted in the circular core hole 11 in an airtight way by cooperating with a bearing 51 and an oil seal 52. The output shaft 40 has an output end 41 and a main shaft body 42. The output end 41 extends out of the bottom lid 50 to connect a motor (not shown in the drawings). The main shaft body 42 is driven by the motor to rotate in the circular core hole 11. The main shaft body 42 is formed with a first eccentric portion 43 relative to the inner end of each pillar plunger 30. The first eccentric portion 43 is connected with a turning wheel 44 leaning against the inner end of each pillar plunger 30. By the first eccentric portion 44 to circle around in the circular core hole 11, the pillar plungers 30 are displaced inward one by one toward the liquid pressurizing room 23 through the eccentric action of the turning wheel 44, enabling the liquid inside the liquid pressurizing room 23 to be pressurized by the pillar plungers 30 so as to discharge from the liquid inflow and outflow opening 13. Through the liquid outflow non-return end of the check valve 14, the pressurized liquid flows out through the liquid outlet 16 for use.

The circular core hole 11 of the pump main body 10 is radially provided with an installation hole 17 interlaced with the fixing holes 12. The output shaft 40 is mounted in the circular core hole 11 by means of the bottom lid 50 and the inner lid 60. The main shaft body 42 is formed with a second eccentric portion 45 relative to the installation hole 17. The main shaft body 42 is axially formed with an oil supply hole 46. The inner lid 60 is formed with an oil through hole 62 relative to the oil supply hole 46. The oil through hole 62 is sealed by an outer lid 70 to form an oil supply room 71. One end of the oil supply room 71 is connected with an oil pipe 80 through a connector 72. Another end of the oil supply room 71 is in communication with the oil supply hole 46 via the oil through hole 62.

The oil supply hole 46 is radially provided with at least one oil outlet 47 relative to the first eccentric portion 43. The oil outlet 47 extends out of the surface of the first eccentric portion 43. The installation hole 17 of the pump main body 10 is provided with an oil supply device 90. The oil supply device 90 is disposed at an outer end of the installation hole 17 and provided with an oil outflow check valve 91. An outer end of the oil outflow check valve 91 is connected with the oil pipe 80 through a pipe connector 92. The interior of the oil outflow check valve 91 is formed with an oil pressurizing room 93. The oil pressurizing room 93 is provided with a telescopic piston 95 biased by a compression spring 94. The telescopic piston 95 has an oil inflow check valve portion 96 able to slide up and down within the oil pressurizing room 93. One end of the oil inflow check valve portion 96 is provided with a push pipe 97 which extends toward the circular core hole 11 to lean against the second eccentric portion 45 of the output shaft 40. One end of the push pipe 97 extends into the circular core hole 11 and is provided with at least one drawing oil hole 98 for the oil pressurizing room 93 to communicate with the circular core hole 11.

When the output shaft 40 is driven by the motor, each pillar plunger 30 driven by the turning wheel 44 on the first eccentric portion 43 is reciprocated in the liquid pressurizing room 23 of the corresponding pillar plunger cap assembly 20. When the liquid in the liquid pressurizing room 23 is pressurized to be outputted for use from the liquid outlet 16, as shown in FIGS. 6 and 7, the telescopic piston 95 of the oil supply device 90 is biased by the compression spring 94 and the end of the push pipe 97 constantly leans against the second eccentric portion 45 of the output shaft 40 to be pushed intermittently, such that the telescopic piston 95 is reciprocated up and down in the oil pressurizing room 93 along with rotation of the second eccentric portion 45.

Figure 6:
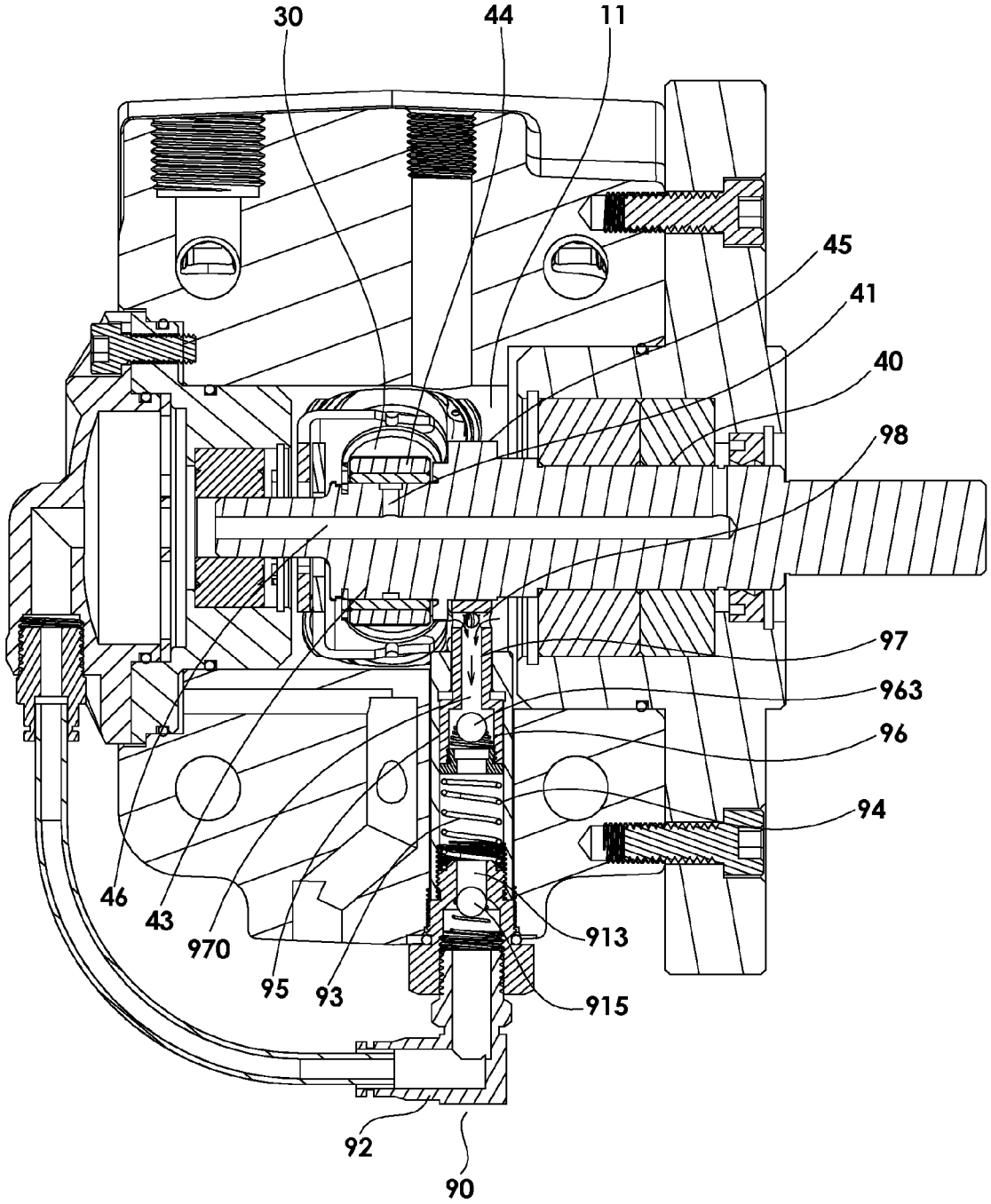
FIG. 6 is a schematic view when the oil supply device of the invention draws oil.

As shown in FIG. 6, when the telescopic piston 95 is displaced outward toward the oil pressurizing room 93, the oil pressurizing room 93 forms negative pressure, the oil inflow check valve 96 is opened, and the lubricating oil in the circular core hole 11 is drawn from the drawing oil hole 98 to fill the oil pressurizing room 93.

Figure 7:
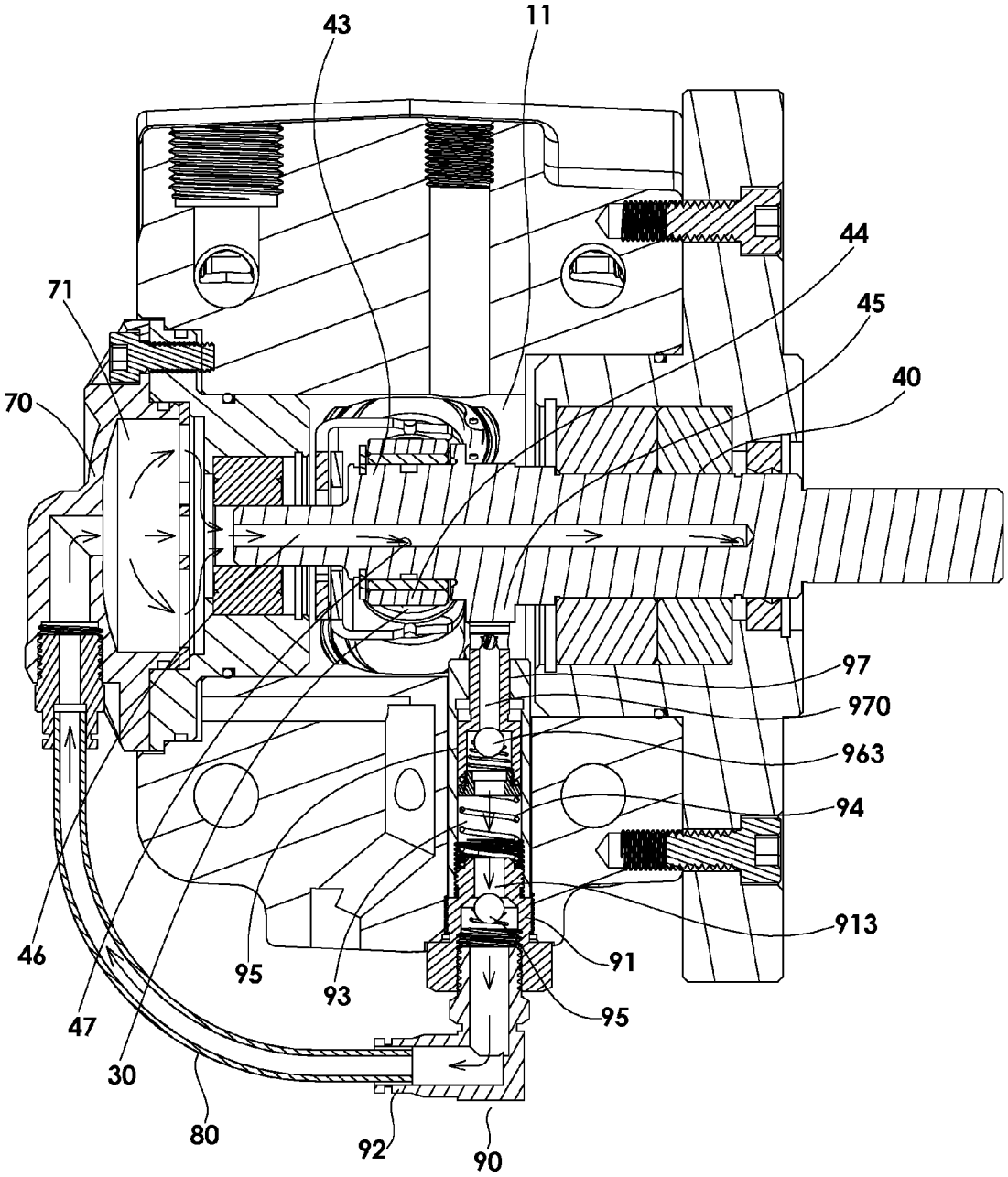
FIG. 7 is a schematic view when the oil supply device of the invention supplies oil.

As shown in FIG. 7, when the telescopic piston 95 is displaced inward toward the oil pressurizing room 93, the oil pressurizing room 93 forms positive pressure, and the oil is pushed by the telescopic piston 95 to the oil inflow check valve 96 to be outputted to the oil supply room 71 of the outer lid 70 along the oil pipe 80. The oil supply hole 46 inside the output shaft 40 can get the pressurized oil from the oil supply room 71 to force the oil outlet 47 to drain the lubricating oil to the surface of the first eccentric portion 43, resulting in that the lubricating oil flows back to the circular core hole 11.

Figure 3:
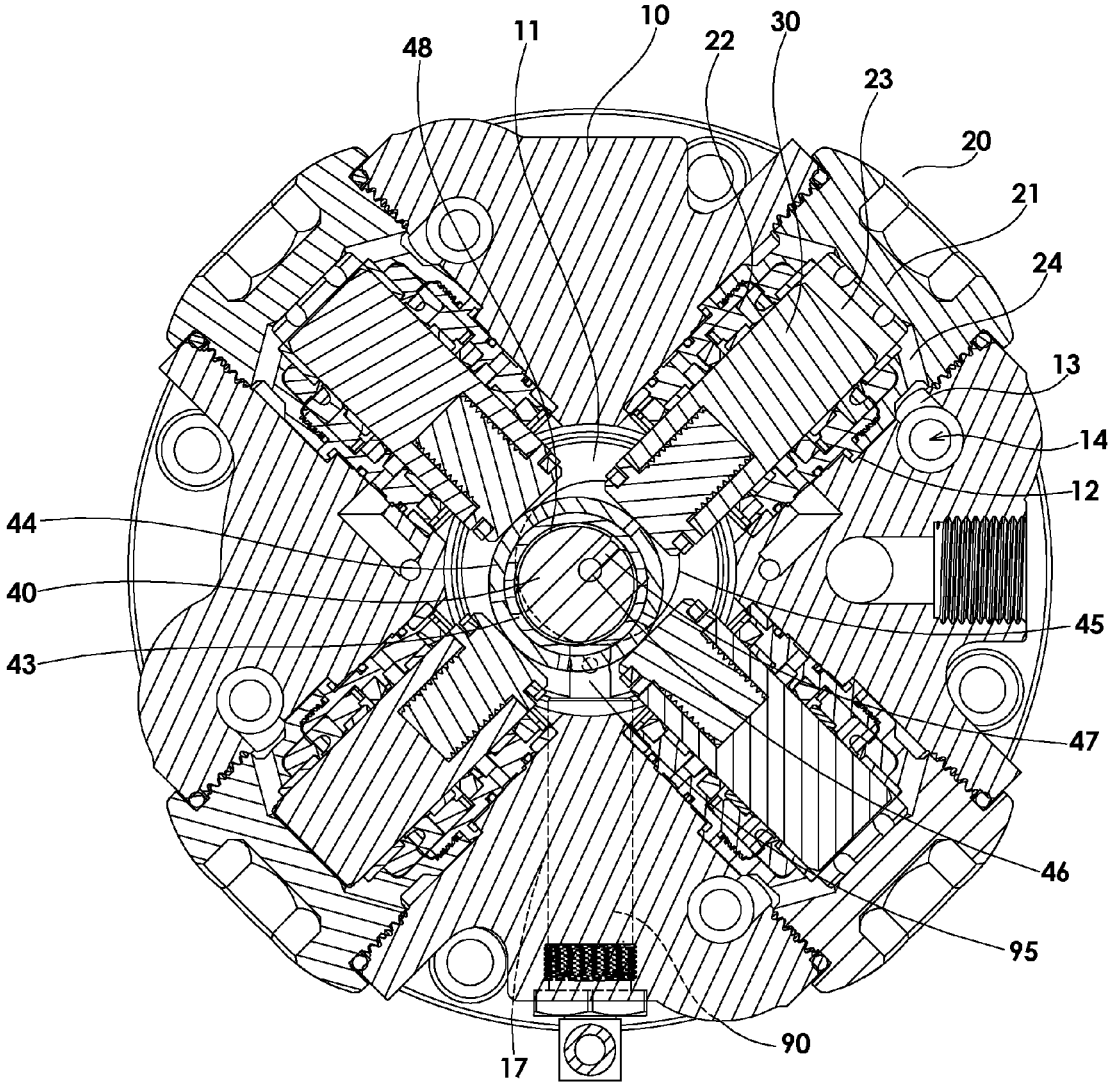
FIG. 3 is a transverse sectional view of the pump main body of the invention.

As shown in FIG. 3, FIG. 6 and FIG. 7, the first eccentric portion 43 of the output shaft 40 acts as the maximum stress for load when the liquid is pressurized and works. By the power of the output shaft 40, the telescopic piston 95 of the oil supply device 90 is directly pushed by the second eccentric portion 45 to draw the lubricating oil in the circular core hole 11 and to pressurize and supply the lubricating oil to the oil supply hole 46 of the output shaft 40 to force the oil outlet hole 47 to drain the lubricating oil to the surface of the first eccentric portion 43 for circulatory supplement, such that the turning of the turning wheel 44 on the first eccentric portion 43 can keep better lubrication for a long time so as to prolong the service life of the output shaft 40 and the turning wheel 44.

Figure 2:
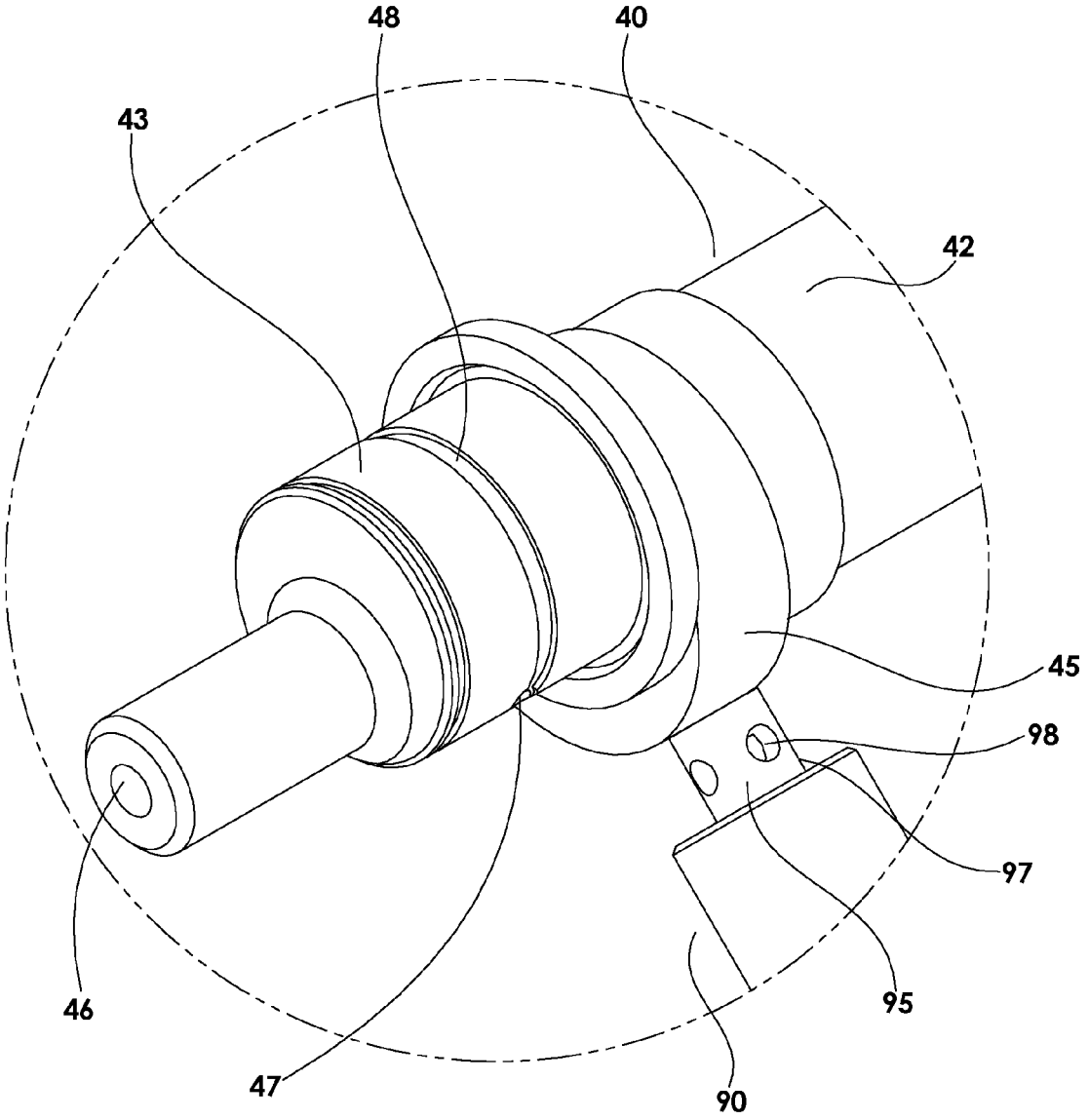
FIG. 2 is a detailed view of the area in circle A of FIG. 1.
Figure 4:
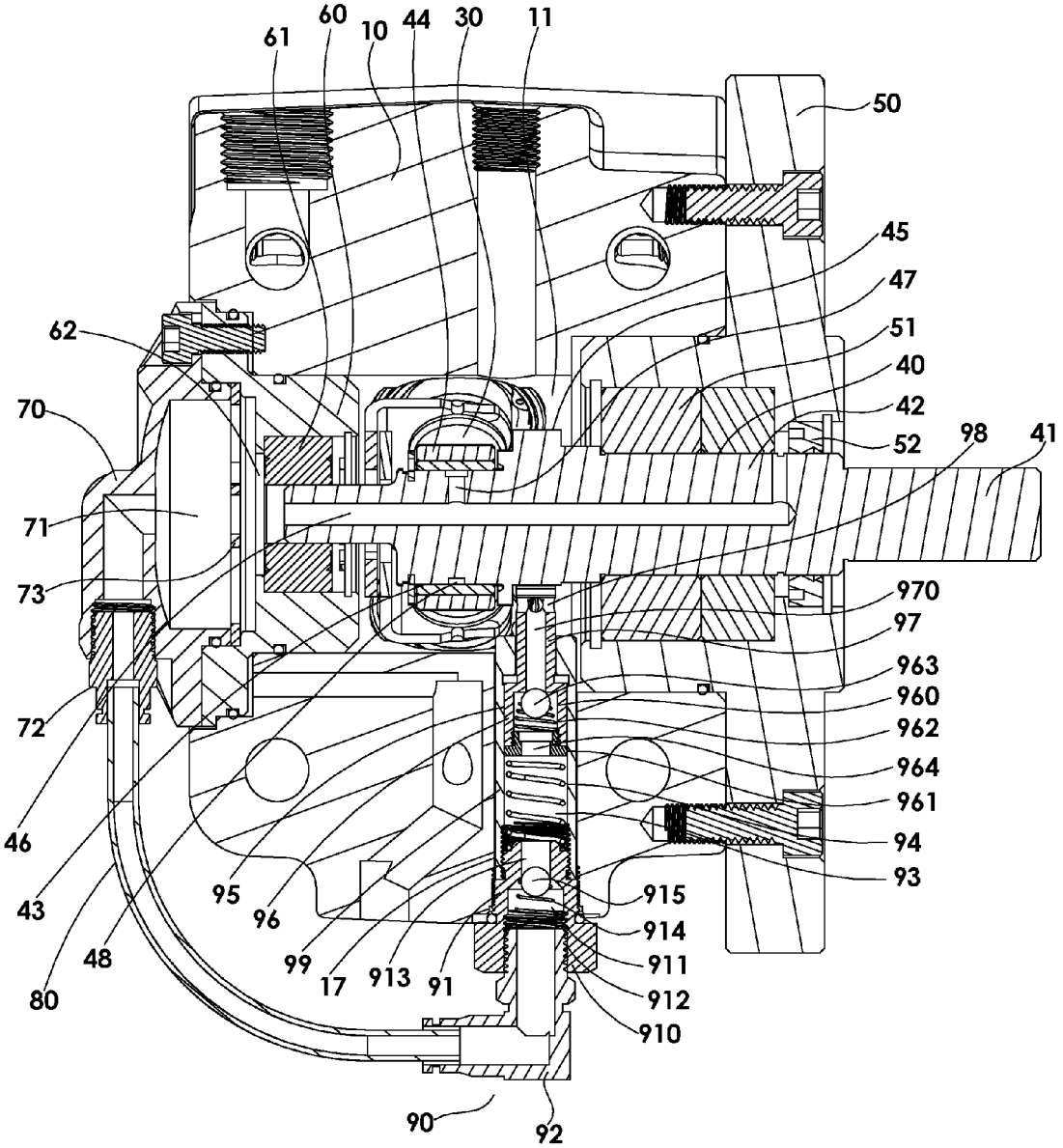
FIG. 4 is a vertical sectional view of the pump main body of the invention.

According to the aforesaid embodiment, as shown in FIG. 1, FIG. 2, and FIG. 4, the oil supply hole 46 inside the output shaft 40 is radially formed with at least one oil outlet 47 relative to the first eccentric portion 43. The surface of the first eccentric portion 43 is formed with an annular groove 48 to communicate with the oil outlet 47, such that the lubricating oil drained from the oil outlet 47 can flow along the annular groove 48, increasing the speed to resupply the lubricating oil to the surface of the first eccentric portion 43 and enabling the turning of the turning wheel 44 on the first eccentric portion 43 to get a full lubricating effect.

According to the aforesaid embodiment, as shown in FIG. 1 and FIG. 4, the oil through hole 62 of the inner lid 60 is sealed by the outer lid 70 to form the oil supply room 71. An oil screen 73 is provided between the oil supply room 71 and the oil through hole 62, such that the iron chippings and impurities contained in the lubricating oil in the circular core hole 11 can be filtered when the oil supply device 90 draws the lubricating oil in the circular core hole 11 and the lubricating oil is circulated and pressurized to flow back to the circular core hole 11 from the oil outlet 47. By the oil screen 73 to filter the impurities, the lubricating oil can be purified.

Figure 5:
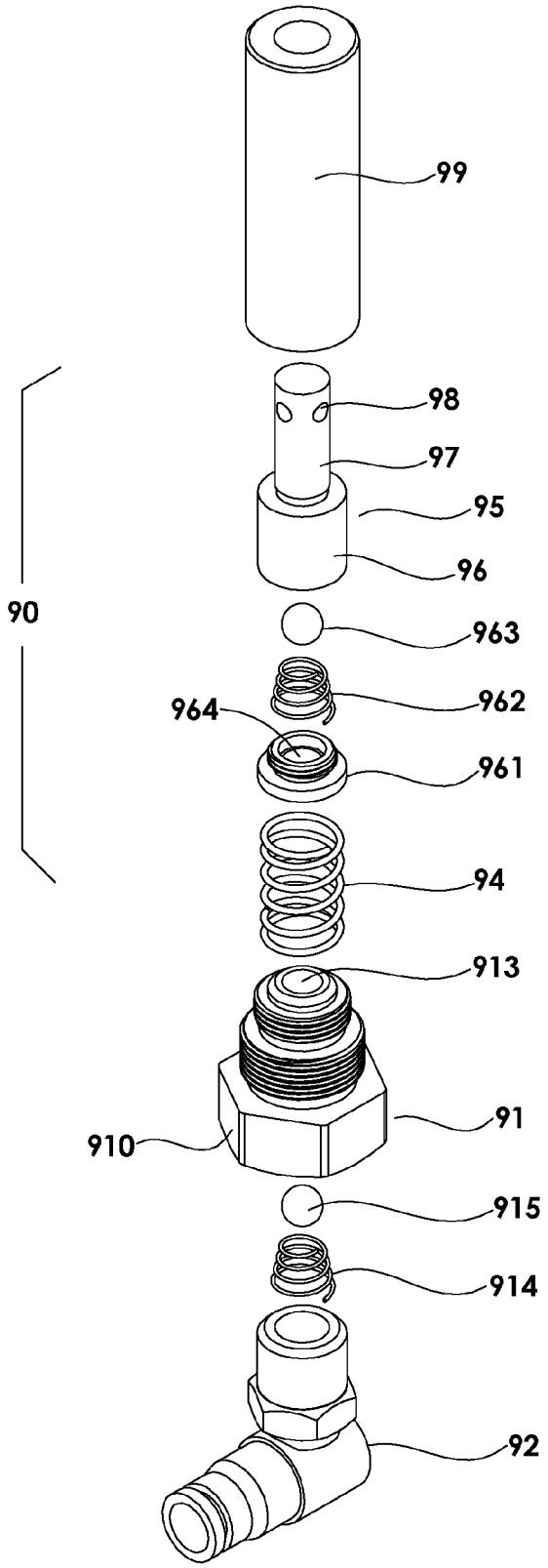
FIG. 5 is an exploded view of the oil supply device of the invention.

According to the aforesaid embodiment, as shown in FIG. 1, FIG. 4, and FIG. 5, the oil outflow check valve 91 of the oil supply device 90 has a valve seat 910. The valve seat 910 is a screw nut to be screwed on a threaded portion of the outer end of the installation hole 17. The valve seat 910 is formed with a valve room 911 therein. One end of the valve room 911 has an inner threaded hole 912 for connecting the pipe connector 92. Another end of the valve room 911 has a valve opening 913 to communicate with the oil pressurizing room 93. The valve room 911 is provided with a tension spring 914 therein. A ball 915 is biased by the tension spring 914 to seal the valve opening 913.

As shown in FIG. 7, when the telescopic piston 95 is pressed by the second eccentric portion 45 of the output shaft 40 to move inward toward the oil pressurizing room 93, the positive pressure generated by the telescopic piston 95 to push the oil in the oil pressurizing room 93 makes the ball 915 depart from the valve opening 913 to open the valve opening 913, resulting in that the pressurizing oil is inputted from the pipe connector 92. On the contrary, when the telescopic piston 95 is pushed back by the compression spring 94 to move outward toward the oil pressurizing room 93, the ball 915 is to seal the valve opening 913 and the oil coming to the pipe connector 92 flows back to oil pressurizing room 93.

According to the aforesaid embodiment, as shown in FIG. 1, FIG. 4, and FIG. 5, the telescopic piston 95 of the oil supply device 90 has the oil inflow check valve portion 96. The oil inflow check valve portion 96 is formed with a valve room 960 therein. One end of the valve room 960 is connected with a pipe hole 970 of the push pipe 97 and communicated with the circular core hole 11 through the drawing oil hole 98. Another end of the valve room 960 is provided with a support member 961 to support a tension spring 962 to press against a ball 963 so as to seal the pipe hole 970. The support member 961 is formed with a through hole 964 for the valve room 960 to communicate with the oil pressurizing room 93.

As shown in FIG. 6, when the telescopic piston 95 biased by the compression spring 94 is moved outward toward the oil pressurizing room 93, the oil pressurizing room 93 forms negative pressure because the oil inflow check valve portion 96 is moved up, resulting in that the ball 963 is drawn by the negative pressure to depart from the pipe hole 970 so that the valve is opened. The lubricating oil in the circular core hole 11 is drawn to the oil pressurizing room 93 from the drawing oil hole 98. On the contrary, as shown in FIG. 7, when the telescopic piston 95 is pushed by the second eccentric portion 45 of the output shaft 40 to move inward toward the oil pressurizing room 93, the ball 963 is to seal the pipe hole 970 so that the oil in the oil pressurizing room 93 flows back to the circular core hole 11.

According to the aforesaid embodiment, as shown in FIG. 1, FIG. 4, and FIG. 5, the oil outflow check valve 91 of the oil supply device 90 is fixedly disposed at the outer end of the installation hole 17. An inner end of the oil outflow check valve 91 is provided with a receiving pipe 99 made of a wear material. The receiving pipe 99 is formed with the oil pressurizing room 93 therein to receive the compression spring 94 and the telescopic piston 95. The push pipe 97 of the telescopic piston 95 extends into the circular core hole 11 from one end of the receiving pipe 99 to lean against the second eccentric portion 45 of the output shaft 40. By the receiving pipe 99, the compression spring 94 and the telescopic piston 95 are mounted on the oil outflow check valve 91, such that the oil supply device 90 can be mounted to or disassembled from the installation hole 17 conveniently.

Figure 8:
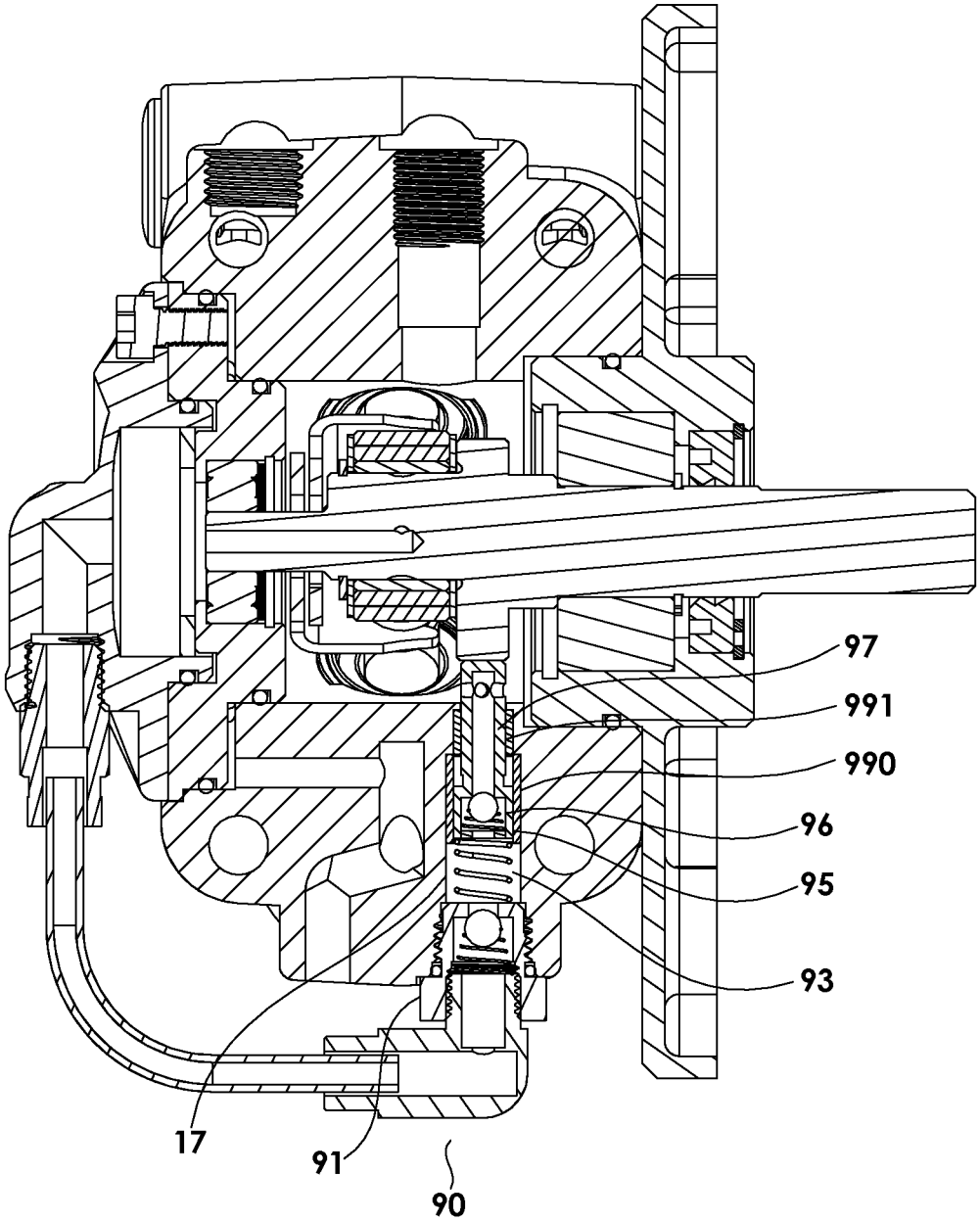
FIG. 8 is a schematic view showing another embodiment of the oil supply device.

The aforesaid embodiment is an embodiment for a small-sized liquid pressurizing pump. As shown in FIG. 8, the oil outflow check valve 91 of the oil supply device 90 is fixedly disposed at the outer end of the installation hole 17. The oil pressurizing room 93 formed at the inner end of the oil outflow check valve 91, relative to the telescopic piston 95, is provided with a first slide sleeve 990 made of a wear material for the oil inflow check valve portion 96 to slide and a second slide sleeve 991 made of a wear material for the push pipe 97 to slide. By the wearing capability of the first and second slide sleeves 990, 991, the slide movement of the telescopic piston 95 in the oil pressurizing room 93 can reduce friction resistance and wear and tear.

Figure 9:
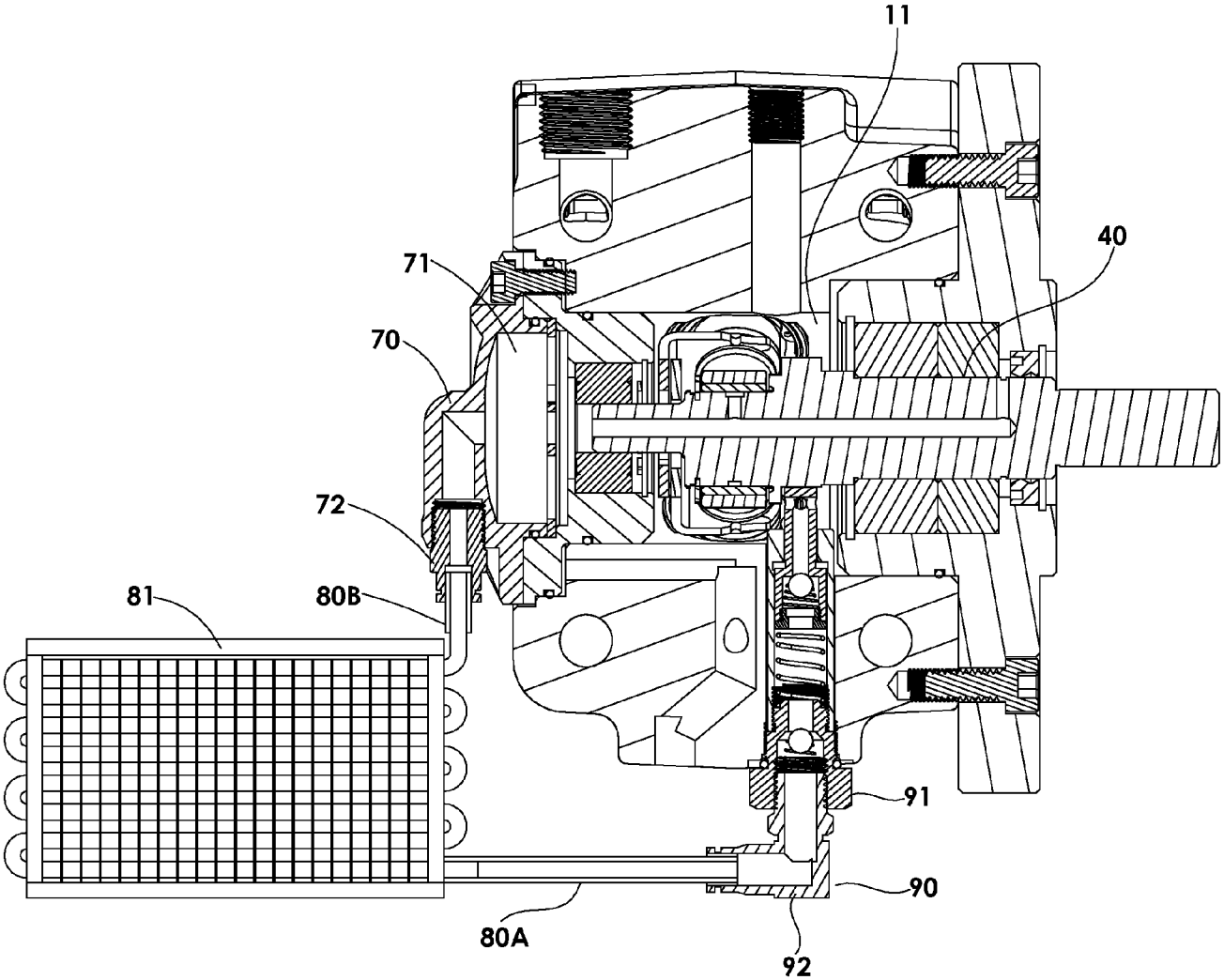
FIG. 9 is a schematic view showing the oil supply device connected with a heat sink.

According to the aforesaid embodiment, as shown in FIG. 9, one end of the oil supply room 71 inside the outer lid 70 is provided with the connector 72. The outer end of the oil outflow check valve 91 of the oil supply device 90 is provided with the pipe connector 92 to connect an oil pipe 80A. Another end of the oil pipe 80A is connected with one end of a heat sink 81. Another end of the heat sink 81 is connected with the connector 72 through another oil pipe 80B. When the lubricating oil in the circular core hole 11 is pressurizing by the oil supply device 90 to be delivered the oil supply room 71, the heat sink 81 is adapted to dissipate heat for the lubricating oil passing there. The operating temperate generated by the output shaft 40 to rotate in the circular core hole 11 can be dissipated by using the circulation of the lubricating oil in the circular core hole 11.

While the invention has been described in terms of preferred embodiments, those skilled in the art will recognize that the invention can be practiced with modifications within the spirit and scope of the appended claims.

What is claimed is:

1. An output shaft lubricating structure of a liquid pressurizing pump, comprising:

a pump main body, a plurality of pillar plunger cap assemblies, a plurality of pillar plungers, and an output shaft;

the pump main body having a circular core hole functioning as a mechanical room and filled with lubricating oil, the circular core hole being provided with a plurality of fixing holes arranged radially and spaced equidistant, each fixing hole being radially provided with a liquid inflow and outflow opening, the liquid inflow and outflow opening being in communication with a check valve, the check valve having a liquid inflow non-return end and a liquid outflow non-return end to communicate with a liquid inlet and a liquid outlet respectively, through the liquid inflow non-return end of the check valve, the liquid inflow and outflow opening being able to get an external liquid from the liquid inlet;

each pillar plunger cap assembly comprising a cap body mounted on a corresponding one of the fixing holes of the pump main body, an interior of the cap body having a liquid pressurizing room, one end of the liquid pressurizing room being radially formed with at least one through hole to communicate with the liquid inflow and outflow opening;

each pillar plunger being disposed in the liquid pressurizing room of each pillar plunger cap assembly, an inner end of each pillar plunger extending into the circular core hole of the pump main body; and the output shaft being locked by a bottom lid and an inner lid which are located at two ends of the circular core hole of the pump main body respectively, the output shaft being mounted in the circular core hole in an airtight way, the output shaft having an output end and a main shaft body, the output end extending out of the bottom lid to connect a motor, the main shaft body being driven by the motor to rotate in the circular core hole, the main shaft body being formed with a first eccentric portion relative to the inner end of each pillar plunger, the first eccentric portion being connected with a turning wheel leaning against the inner end of each pillar plunger, by the first eccentric portion to circle around in the circular core hole, the pillar plungers being displaced inward one by one toward the liquid pressurizing room through an eccentric action of the turning wheel, enabling liquid inside the liquid pressurizing room to be pressurized by the pillar plungers so as to discharge from the liquid inflow and outflow opening, through the liquid outflow non-return end of the check valve, the pressurized liquid flowing out through the liquid outlet for use;

characterized by:

the circular core hole of the pump main body being radially provided with an installation hole, the output shaft being mounted in the circular core hole by means of the bottom lid and the inner lid, the main shaft body being formed with a second eccentric portion relative to the installation hole, the main shaft body being axially formed with an oil supply hole, the oil supply hole being radially provided with at least one oil outlet extending out of the surface of the first eccentric portion, the inner lid being formed with an oil through hole aligned to the oil supply hole, the oil through hole being sealed by an outer lid to form an oil supply room, one end of the oil supply room being connected with an oil pipe through a connector, another end of the oil supply room being in communication with the oil supply hole via the oil through hole; and the installation hole of the pump main body being provided with an oil supply device, the oil supply device being disposed at an outer end of the installation hole and provided with an oil outflow check valve, an outer end of the oil outflow check valve being connected with the oil pipe through a pipe connector, an interior of the oil outflow check valve being formed with an oil pressurizing room, the oil pressurizing room being provided with a telescopic piston biased by a compression spring, the telescopic piston having an oil inflow check valve portion able to slide up and down within the oil pressurizing room, one end of the oil inflow check valve portion being provided with a push pipe extending toward the circular core hole to lean against the second eccentric portion of the output shaft, one end of the push pipe extending into the circular core hole and being provided with at least one drawing oil hole for the oil pressurizing room to communicate with the circular core hole.

2. The output shaft lubricating structure of a liquid pressurizing pump as claimed in claim 1, wherein the surface of the first eccentric portion is radially formed with an annular groove to communicate with the oil outlet.

3. The output shaft lubricating structure of a liquid pressurizing pump as claimed in claim 1, wherein an oil screen is provided between the oil supply room and the oil through hole.

4. The output shaft lubricating structure of a liquid pressurizing pump as claimed in claim 1, wherein the oil outflow check valve of the oil supply device has a valve seat, the valve seat is a screw nut to be screwed on a threaded portion of the outer end of the installation hole, the valve seat is formed with a valve room therein, one end of the valve room has an inner threaded hole for connecting the pipe connector, another end of the valve room has a valve opening to communicate with the oil pressurizing room, the valve room is provided with a tension spring therein, and a ball is biased by the tension spring to seal the valve opening.

5. The output shaft lubricating structure of a liquid pressurizing pump as claimed in claim 1, wherein the oil inflow check valve portion is formed with a valve room therein, one end of the valve room is connected with a pipe hole of the push pipe and communicated with the circular core hole through the drawing oil hole, another end of the valve room is provided with a support member to support a tension spring to press against a ball so as to seal the pipe hole, the support member is formed with a through hole for the valve room to communicate with the oil pressurizing room.

6. The output shaft lubricating structure of a liquid pressurizing pump as claimed in claim 1, wherein an inner end of the oil outflow check valve is provided with a receiving pipe, the receiving pipe is formed with the oil pressurizing room therein to receive the compression spring and the telescopic piston, and the push pipe of the telescopic piston extends into the circular core hole from one end of the receiving pipe to lean against the second eccentric portion of the output shaft.

7. The output shaft lubricating structure of a liquid pressurizing pump as claimed in claim 1, wherein the oil pressurizing room formed at the inner end of the oil outflow check valve, relative to the telescopic piston, is provided with a first slide sleeve made of a wear material for the oil inflow check valve portion to slide and a second slide sleeve made of a wear material for the push pipe to slide.

8. The output shaft lubricating structure of a liquid pressurizing pump as claimed in claim 1, wherein one end of the oil supply room inside the outer lid is provided with a connector, the outer end of the oil outflow check valve of the oil supply device is provided with a pipe connector to connect an oil pipe, another end of the oil pipe is connected with one end of a heat sink, another end of the heat sink is connected with the connector through another oil pipe.

* * * * *